US005865616A

United States Patent [19]

George

[11] Patent Number: 5,865,616

[45] Date of Patent: Feb. 2, 1999

[54] PREMIX GAS BURNER

[75] Inventor: Kenneth Ray George, Leo, Ind.

[73] Assignee: Wayne/Scott Fetzer Company, Westlake, Ohio

[21] Appl. No.: 766,421

[22] Filed: Dec. 12, 1996

[51] Int. Cl.[6] ..... F23Q 9/00

[52] U.S. Cl. ..... 431/284; 431/264; 431/326; 431/329; 239/553.3

[58] Field of Search ..... 431/326, 328, 431/329, 264, 265, 266, 284; 239/553.3, 552

[56] References Cited

U.S. PATENT DOCUMENTS

| | | | |
|---|---|---|---|
| 1,389,107 | 8/1921 | Torrey | 239/553.3 |
| 2,874,001 | 2/1959 | Webb | 239/553.3 |
| 3,612,738 | 10/1971 | Jones et al. | 431/265 |
| 3,758,265 | 9/1973 | Hein | 239/553.3 |
| 5,484,108 | 1/1996 | Nally | 239/553.3 |

FOREIGN PATENT DOCUMENTS

| | | | |
|---|---|---|---|
| 561892 | 4/1957 | Italy | 431/266 |

*Primary Examiner*—Carroll Dority
*Attorney, Agent, or Firm*—Wood, Herron & Evans, LLP

[57] ABSTRACT

A premix gas burner has a flat, composite burner plate formed by a rear flat plate having a first set of apertures and a forward flat and thinner plate having a second set of apertures of less diameter than the first set of apertures. The plates are connected to form a composite burner plate at the front end of a burner tube. A pilot tube extends through the burner tube and a pilot flame ignitor includes an insulated center electrode and a spirally wrapped grounding electrode electrically engaging the I.P. of the pilot tube to form an electrical ground. The electrodes spark to ignite a pilot flame which in turn ignites the larger burner flame.

27 Claims, 3 Drawing Sheets

PREMIX GAS BURNER

BACKGROUND OF THE INVENTION

This invention relates to burners and particularly to premix gas burners used, for example, in boiler or other heat exchangers for heating and other systems.

Burners used in boiler or heat exchange systems, for example, have in the past included a main gas tube wherein gas is ignited by a direct spark. Such direct spark "ignition" is sensitive to ignition timing and to the flow and mix characteristics of the gas and air mixture. If the flow starts too far ahead of the spark, or if the flow is not homogeneous or not in the proper ratio, the light off of the burner flame can be exciting. The process can result in a delayed light off, causing damage or at least an annoying "boom" in the system. Moreover, when the ignitor is disposed within the main gas flame, it is constantly heated and is prone to increased deterioration.

In another aspect of gas burners, it is common to direct mixed gas and air through a burner plate which serves to define a flame front. It is desirable to fashion such plates from metal and to provide apertures therethrough for the gas and air mixture. In order to provide for efficient burning, it has been suggested to use a shaped metal sheet providing a plurality of gas passages therethrough. U.S. Pat. No. 4,397,631 illustrates one example of such a burner. In that patent, holes are provided in a thin metal member which is contoured. Such contour lends strength and rigidity to the burner plate when thin metal is used. Without strengthening contours, thin burner plates tend to warp and distort in the presence of the burner heat.

When providing a burner plate, it is desirable to use a plurality of gas and air apertures therein. Problems are presented, however, as a function of hole size to metal thickness when combined with use in a very hot environment. For example, where thin metal is used, the heat generated by the burner flame can cause the metal burner plate to warp and distort, adversely affecting the flame front. On the other hand, where thicker metals are used, the ability to provide holes of smaller diameter than the metal thickness is compromised. Specifically, as metal thickness increases, it becomes more difficult to punch a hole of a given diameter smaller than that thickness. As a rule of thumb, where the hole diameter is smaller than the metal thickness, punches break more often and tooling expense in manufacturing increases. Nevertheless, a number of holes of or below a certain diameter are required on the plate area to pass the gas and air mixture properly and produce the desired flame front. A designer is thus caught between the need to use a thick burner plate for rigidity and the need to use small diameter holes to produce a stable flame front. Accordingly, it is difficult to provide the necessary cross-sectional gas and air flow areas through a burner plate in a material thick enough to prevent warpage and distortion in the presence of a burner flame and at the same time produce a desired flame front without flashback.

It is thus one objective of this invention to provide an improved ignition apparatus for a gas-fired burner and to avoid the direct spark light off of the main burner flame.

Another objective of this invention has been to provide an improved burner plate with sufficient gas and air flow, yet sufficiently strong enough to withstand warpage distortion and to prevent flashback when used proximate a burner flame.

In another but related aspect of gas burners, it is important to produce a stable flame front which does not jump or migrate across the burner face at an audible resonance sounding like a high squeal. This can occur when the gas and air flow holes are too big.

Another objective of the invention has thus been to quiet gas burners during operation.

To these ends, a preferred embodiment of the invention comprises a premix gas burner having a blower for forcing air through the burner, a burner tube for receiving gas and air, a pilot tube extending through the burner tube for conveying pilot gas to a burner end of the burner tube and supporting two members of a composite burner plate. An ignitor extends through the composite burner plate for igniting gas flowing through the pilot tube to produce a pilot flame just outside the burner plate. When the main gas is started, the pilot flame ignites it easily, without damage or the 'boom' associated with a direct spark ignitor.

The ignitor itself includes a center electrode encased in an insulating sleeve, and another electrode wrapped spirally around the sleeve and extending forwardly with, but spaced from, the center electrode. When the ignitor is assembled in the pilot tube, the outer surfaces of the wrapped electrode engage the inner surface of the pilot tube, forming an electrical ground. On application of current to the center electrode, a pilot spark is created across the tips of the two electrodes to ignite a pilot flame. After the pilot is lit, the main gas and air flow is started and is ignited softly by the pilot flame. Since the electrodes remain in the rich gas and air flow of the pilot tube, such flow tends to cool them even when the main flame is lit.

In another aspect of the invention, the burner plate is a composite of two flat component plates. The outer or forward component plate has a plurality of small holes while the inner or rearward component plate has a plurality of larger holes. The two plates are welded together so each larger aperture in the inner plate overlies a plurality of smaller apertures in the outer plate. The matrix between the larger apertures in the inner plate blocks underlying smaller apertures and provides a surface for spot welding the plates together. Gas and air mixture flows from inside the burner tube through the larger holes and then through the smaller apertures to outside the composite plate where the mixture is ignited by the pilot flame and then the main gas flame in a flame front.

The inner and out component plates are each individually relatively thin, thus accommodating holes in each of a diameter in excess of each respective plate thickness. The thinness of the plates accommodates the desirable hole sizes. Yet when the plates are welded together, they form a composite, flat burner plate sufficiently strong enough to withstand heat of the burner without warpage or distortion, even though the composite plate is flat, and without strengthening contours. The composite plate also provides appropriate flow apertures preventing flashback and flame front migration, quieting the burner operation.

Moreover, since the plates are captured on the pilot tube, the entire pilot tube and burner plate can be easily removed and serviced from the rear of the burner, it being unnecessary to disassemble the entire burner from its environment for service.

These and other objectives and advantages will become readily apparent from the following written description of a preferred embodiment of the invention and from the drawings in which.

Figure 1:
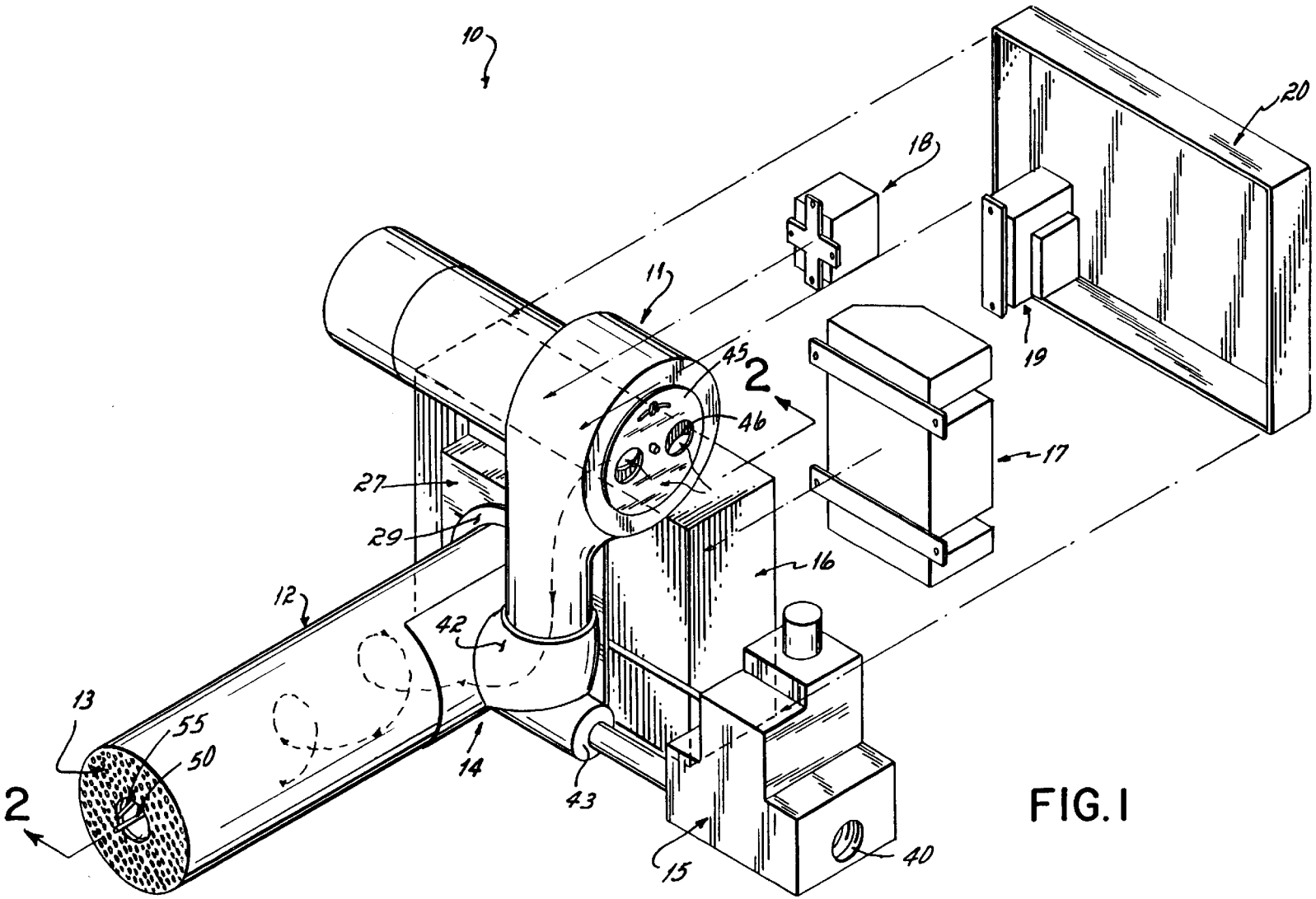
FIG. 1 is a perspective view in partially exploded format showing a premix burner according to one embodiment of the invention.

Turning now to the drawings, there is shown in FIG. 1 thereof, a premix gas burner 10 according to a preferred embodiment of the invention. As illustrated in FIG. 1, the burner includes a blower 11, a burner tube 12 and a burner plate 13 at the forward end of the burner 12. The blower 11 is attached to the burner tube 12 via a blower adapter 14. The main and pilot gas valve assembly 15 comprises two gas valves operative to supply gas to the blower adapter 14 and to the rear end of the gas pilot system, respectively, as will be described.

A control box 16 is disposed at the rearward end of the burner tube 12. It generally houses an ignition control 17, a blower motor relay 18 and a power transformer 19. A control box cover 20 serves to close off the control box 16 with the various ignition controller 17, motor relay 18 and power transformer 19 therein.

It will be appreciated that any other necessary circuitry and terminals are provided within the control box 16 so that in assembled form, the premix gas burner 10 simply comprises the burner tube 12 with burner plate 13, the blower 11 and the blower adapter 14, the gas valve 15 and control box 16. Any suitable blower and motor relay, together with any suitable power transformer and ignition controller, can be utilized and neither these elements, nor the gas valve 15 themselves form any part of the present invention.

Figure 2:
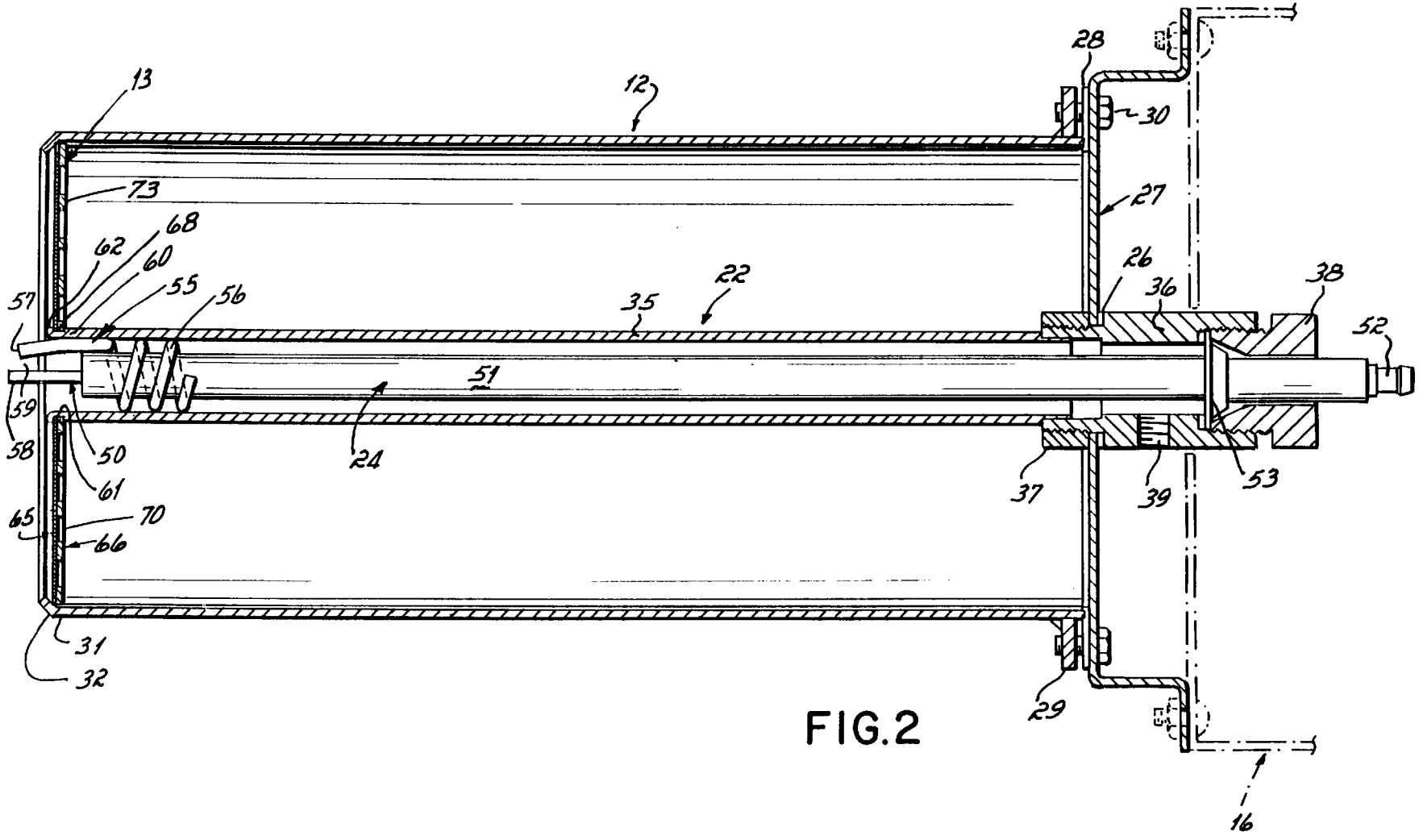
FIG. 2 is a cross-sectional view of the burner tube of the burner of FIG. 1, as viewed generally along lines 2—2 of FIG. 1.

Turning now to FIG. 2, there is shown therein further details of the premix burner including the burner tube 12, the burner plate 13, the pilot apparatus 22 and the ignitor apparatus 24.

Considering first the burner tube 12 and its orientation as part of the premix gas burner, it will be appreciated that the tube 12 is mounted on a burner tube end plate 27, which itself is attached to a forward side of the control box 16. A burner tube gasket 28 is interposed between the end plate 27 and the burner tube 12 and the burner tube is mounted on the burner end plate 27 by means of an annular flange 29 secured to the burner tube 12 and the bolts 30 as shown in FIG. 2. It will be further appreciated that an ignitor bushing gasket 26 is preferably utilized between the shoulder on ignitor bushing 36 and the rear end plate 27 as shown in FIG. 2.

The burner tube 12 is generally cylindrical in configuration and extends forwardly from right to left, as viewed in FIG. 2, to a forward end 31, where it terminates in an inwardly turned flange 32.

Turning now to a description of the pilot apparatus 22, and ignitor apparatus 24, it will be appreciated that the pilot apparatus 22 includes a pilot tube 35 received at its rear end in an ignitor bushing 36, which extends through the end plate 27 as shown, and has a forward threaded end secured by an ignitor bushing nut 37. The pilot tube 35 may reside within the ignitor bushing 36 in a frictional slip fit. An ignitor nut 38 is screwed into the rear end of the ignitor bushing and seals off the open rear end thereof.

A pilot gas inlet aperture 39, internally threaded, is provided for receiving pilot gas from a pilot gas valve in the main and pilot gas valve 15. In this regard, and returning momentarily to FIG. 1, it will be appreciated that the main and pilot gas valve 15 includes a gas inlet 40. The main and pilot gas valve 15 includes preferably two valves; one for feeding gas to the burner tube 12 as will hereinafter be described, and one for feeding gas through an appropriate conduit to the pilot gas inlet or aperture 39 in the ignitor bushing 36.

It will be appreciated that gas fed through the pilot gas inlet 39 in the ignitor bushing moves through the ignitor bushing and into the pilot tube 35, where the gas moves from right to left or forwardly toward the forward end 31 of the burner tube.

Returning again momentarily to FIG. 1, it will be appreciated that the blower adapter 14 includes a blower inlet 42 and a gas inlet 43. Gas inlet 43 is operably connected to the main and pilot gas valve 15 for receiving main gas from one of the valves in the valve assembly 15 and for commingling the gas with the air discharging from the blower in the blower inlet 42.

It will be appreciated in this regard that, when the blower and the gas valve are both on, the gas and air are mixed and are swirled within the blower tube 12 where the mixed gas and air move around the blower tube 12 outside the pilot tube 35, toward the forward end 31 of the burner tube and through the burner plate 13, where the main gas and air mixture is eventually ignited, as will be described.

It will be appreciated, of course, that the blower 11 incorporates shutter plates 45, 46 for controlling the air flow into the blower, as illustrated in FIG. 1. The dotted line arrows in FIG. 1 indicate the flow of air from the blower through the blower inlet 42, the blower adapter 14 and into the burner tube 12.

Turning now to FIG. 2, it will be appreciated that the ignitor and sensor apparatus 24 includes a center electrode 50 surrounded by an insulating sleeve 51 residing within the pilot tube 35. The center electrode and sensor 50 has a rear end terminal 52 for interconnection to the ignition controller. In this regard, it will be appreciated that the center electrode 50 in terminal 52 are electrically insulated from the ignitor bushing 36 and the ignitor nut 38 by means of the electrically insulative sleeve 51 and the flange 53 within the ignitor bushing 36.

At the forward end of the ignitor and sensor apparatus 24 is located a grounding electrode 55. Grounding electrode 55 has a spiral portion 56 and a forward tip 57 extending forwardly of the burner tube 12 and forwardly of the burner plate 13.

As shown in FIG. 2, it will be appreciated that the spiral portion 56 and the forwardly elongated tip 57 are in direct contact with the pilot tube 35. There is an electrical interface thus between the electrode 55 and the pilot tube 35, such that the grounding electrode 55 is interconnected through the pilot tube 35, the ignitor bushing 36, the ignitor bushing nut 37 and the rear end plate 27 to the control circuitry and the control box 16.

It will be appreciated that the forward tip 57 of the grounding electrode and the forward tip 58 of the center electrode define a gap 59 therebetween. When electrical current is connected operably to the center electrode 58, a spark is generated across the gap 59 for igniting mixed pilot gas and air flowing through the pilot tube 35 from the rear end toward the forward end.

In this regard, it will be appreciated that as pilot gas is introduced to the inlet 39, it flows forwardly through the tube 35 and when it flows around the spiral portion of the grounding electrode 55, the gas is swirled around the spirals of that electrode and then it is emitted through the forward end 60 of the tube 35 to form a pilot gas which is ignited by the spark in the gap 59 to provide a pilot flame (not shown).

In this regard, it will be appreciated that the forward end 60 of the pilot tube 35 is disposed within a central aperture of the burner plate 13, as will be described. Preferably, a groove 61 is provided in the forward end 60 of the pilot tube 35 for receiving the burner plate 13 and a forward flange 62 is flared outwardly to capture the burner plate 13 in the groove.

Figure 5:
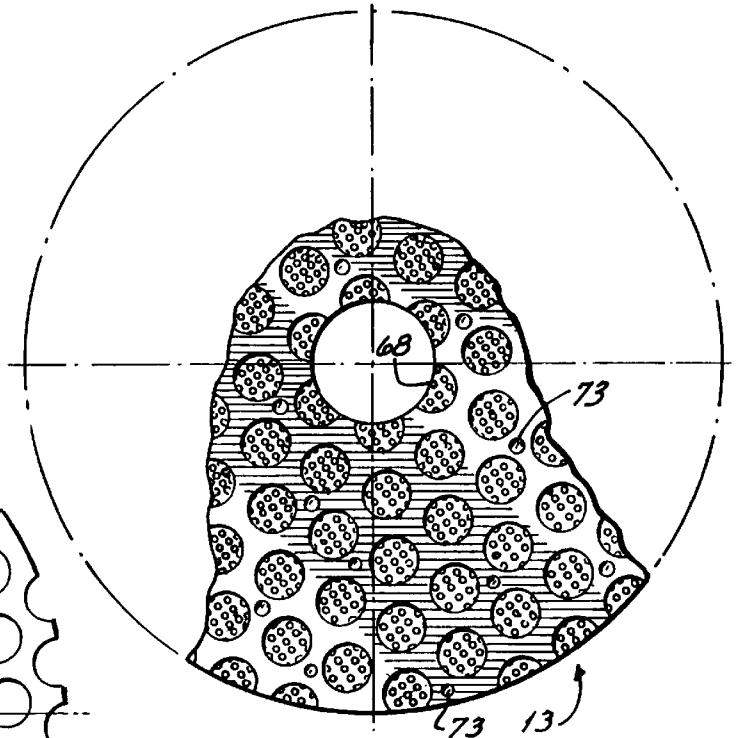
FIG. 5 is an elevational view of both inner and outer plates secured together, as viewed from inside the burner tube.
Figure 4:
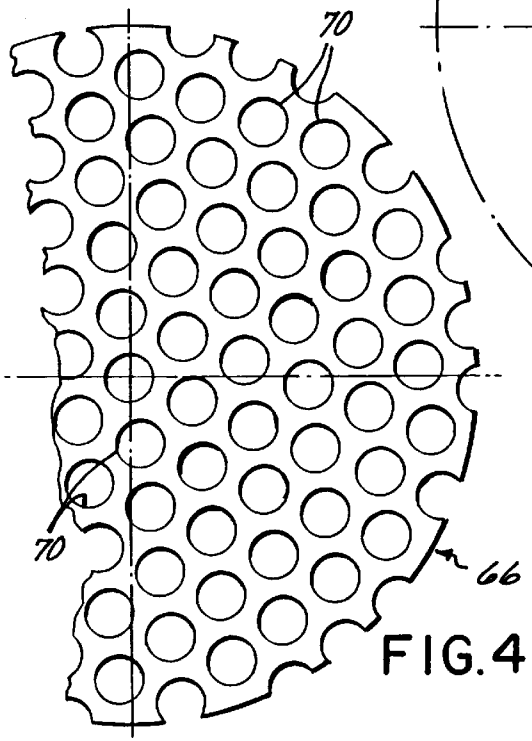
FIGS. 3 and 4 are elevational front views respectively of outer and inner sub-plates for the burner plate.
Figure 3:
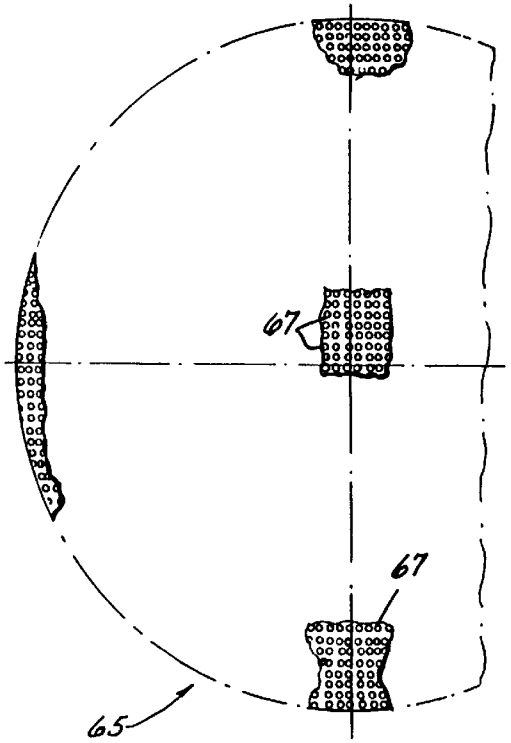

Turning now to FIGS. 3, 4 and 5, the composite burner plate 13 will now be described.

The plate 13 includes a forward component burner plate 65 as shown in FIG. 3 and a rearward component burner plate 66 as shown in FIG. 4. The two plates 65, 66 are preferably welded together to form the composite plate 13, as best seen in FIG. 5.

Returning now to FIG. 3, the forward burner plate comprises preferably a stainless steel material such as 304 stainless steel of 26 gauge thickness, that is 0.018 inches. Flow apertures, such as illustrated at 67, are provided over the surface of the plate 65. The apertures 67 are preferably 0.033 inches in diameter, disposed on 0.055 inches straight centers throughout the plate. The entire plate could be of any suitable size, and it is preferably, in one application, approximately three to four inches and, specifically, a little over 3.8 inches in diameter. Of course, any size burner tube may be used to fit particular applications and this forward and rearward burner plate 65, 66 will be sized accordingly.

Turning now to FIG. 4, the rearward burner plate 66 is provided with a plurality of apertures 70 throughout. Rearward burner plate 66 can be made of any suitable material and, in one application, is made of 304 stainless steel of 18 gauge thickness, that is 0.049 inches thick. The apertures 70 comprise holes ¼ inch in diameter on 0.313 inch staggered centers. The diameter of the plate 66 is preferably the same as that of the forward burner plate 65.

The two plates shown in FIGS. 3 and 4 are combined as shown in FIG. 5 to provide a composite burner plate 13. As viewed from the rear, or from within the burner tube 12, it will be appreciated that the apertures 70 of the rearward plate 66 overlie a plurality of the apertures 67 in the forward plate 65.

When the two plates 65, 66 are combined, they are connected together preferably by spot welds residing in the matrix of the rearward burner plate 66 to thereby secure the two plates together. Such welds are illustrated, for example, at 73 in FIG. 5 and are also graphically illustrated at 73 in FIG. 2.

The composite burner plate 13 is thus approximately 0.067 inches thick or thicker, as determined by the thickness of the of the resistance or spot weld 73.

Accordingly, the relatively thin plates are used to accommodate appropriate hole sizes for gas and air flow but the combination of the plates produces a composite plate strong enough to withstand distortion in the presence of the burner heat. The thicker plate serves to add significant rigidity to the composite plate, while the multiplicity of smaller holes in the thinner plate produces a unique pattern flame front, with good retention of small stable flames which do not migrate across the burner plate at a resonance to produce an annoying squeal.

A central aperture 68 is drilled in the assembled plate 13. Alternatively, separate apertures may be formed in each of the plates 65, 66. These would also be in register to define the center aperture 68 as viewed in FIG. 5. It is this aperture through which the forward end 60 of the pilot tube 35 extends, as shown in FIG. 2. In a burner nominally described as a six inch burner, with the burner plates as described in FIGS. 3 through 5, the center aperture may be approximately just under 7/10 of an inch in diameter. It will be appreciated that hole 68 is formed in the plates 65, 66 after the gas apertures are formed therein. Thus, the components 65, 66 as shown in FIGS. 3 and 4 without the center holes 68, 71 yet formed.

Having described the specific structure of various aspects of the invention, the burner is further described by reference to FIG. 2, where it will be appreciated that, when the combined burner plate 13 is mounted on the forward end 60 of the pilot tube 35, the burner plates can be inserted into the rear end of the burner tube 12 and moved forwardly until they engage the inward flange 32 at the forward end 31 of the burner tube 12.

The outer circumference of the burner plate 13 is thus held from further forward movement by the flange 32. At the same time, the burner plates support, and are supported by, the forward end 60 of the pilot tube 35.

When the rear end of the pilot tube 35 is secured within the ignitor bushing 36, and that bushing is secured to the end plate 27 by means of the ignitor bushing nut 37, the burner plate 13 is thus secured at the forward end of the burner tube 12, held against forward motion by the flange 32 and against rearward motion by the interconnection of the aperture 68 and burner plate 13, with the groove 61 and the forward end 60 of the pilot tube 35.

Nevertheless, it will be appreciated that the entire burner can be serviced from the rear end. That is, the control box cover 20 can be removed and the ignitor and sensor apparatus 24 can be removed from the rear of the burner simply by removal of the ignitor nut 38. Thus, the entire ignitor assembly can be removed for replacement or repair if necessary, without disassembly of tube 12 or other components of the burner from the permanent mounting.

Moreover, if it is desired to service the burner plate 13, the burner tube 12 can be disconnected from the rear end plate 27 and the burner plate 13 and pilot tube 35 assembled together, can be removed from the rear end of the burner tube 12.

It will also be appreciated that, as pilot gas is introduced to the inlet 39, it flows to the left or forwardly, as viewed in FIG. 2, flowing over the sleeve 51 and the electrode 56, and then over the forward tip 57 and the forward tip 58 of the ground electrode 55 and center electrode 50. This gas flow tends to cool the electrodes in the forward end of the pilot apparatus even while the burner is being operated.

In operation, the pilot gas valve in the main and pilot gas valve 15 is opened and pilot gas flows through the pilot tube 35. At the appropriate time, an electrical current is supplied to the rear terminal 52 of the center electrode 50 and a spark is generated across the gap 59, thereby igniting the pilot gas flowing through the tube 35. Since the flow of the pilot gas is relatively small compared to the main gas and air mixture, the pilot flame is lit easily and without the necessity of creating a spark in the main gas and air flow.

Once the pilot light is burning, the center electrode 50 provides an electrical indication of the flame presence due to ionization, indicating that the pilot flame is burning. This is sensed by the ignition control which then energizes the blower and the main gas valve to start the flow of the main gas and air mixture in the burner tube 12.

As this mixture flows forwardly, it moves through the composite burner plate 13, first through the larger apertures and then into the groups of smaller apertures in the forward plate 65. Once the gas is emitted from the burner plate 13, it is ignited by the now-burning pilot flame on the outside of the burner tube 12. The pilot flame provides a large flame pilot ignition, for example, which easily and softly ignites the main gas air mixture without unnecessary booms or explosions.

Thereafter, it does not make a difference whether or not the pilot flame continues to be lit, as continuing main gas and air flow maintain the burner flame front on the outside of the plate 13. Pilot gas flow may be continued, however, if desired, in order, for example, to aid in cooling the forward end of the ignitor and sensor system.

In this regard, it will be appreciated that other forms of sensors could be utilized to indicate the burning of the pilot flame, and that the utilization of the central electrode 50 as the pilot flame sensor in and of itself does not form part of the invention here claimed.

With further reference to FIGS. 3 and 4, it will be appreciated that the forward and rearward burner plates 65, 66, while each of them are relatively thin, they both accommodate the punching of the various apertures 67, 70 therein, which are respectively of a greater diameter than each of the individual and respective plates in thickness, yet are small enough to produce a desired flame front. Thus, use of the composite plate as described accommodates use of holes in each plate larger than the respective plate's thickness, but when the plates are combined, the apertures cooperate to produce a desired stable flame front, which does not migrate and cause an operating resonance or squeal, and wherein the composite plate is also strong enough to withstand warpage and distortion. The combination of the two plates together, as illustrated in FIG. 5, thus forms a strong composite burner plate 13 which does not warp or distort in the presence of heat generated by the flame burning on the mixture of the main gas and air flow flowing through the burner plate 13.

The burner plates 65, 66 in the composite plate 13 thus can be flat, as shown, and are not required to have any profile, or other contour or geometric shape.

It will be appreciated that the premix gas and air burner apparatus 10, as described above, can be of any suitable size, such as 6, 9 or 12 inches and can be used for numerous and various applications where a burner is required. It will also be appreciated that the burner provides for a very soft light-off of the main gas and air mixture by means of the pilot flame described above, as opposed to a direct spark ignition of the main gas and air mixture.

It will also be appreciated that a suitable flame front is provided by the composite plate 13 without the necessity of manufacturing the burner plate 13 in various geometric, three-dimensional shapes.

Moreover and as noted above, it will be appreciated that the entire burner can be serviced from the rear end.

These and other advantages and modifications will become readily apparent to those of ordinary skill in the art without departing from the scope of the invention, and the applicant intends to be bound only by the claims appended hereto.

What is claimed is:

1. A burner plate for a premix gas burner and comprising:

a front plate having a first plurality of apertures therein;

a rear plate having a second plurality of apertures therein, said second plurality of apertures having diameters larger than those of said first plurality of apertures;

apertures of said second plurality being disposed in operative alignment with, and overlying apertures of, said first plurality;

said plates being secured together to form a unitary burner plate.

2. Apparatus as in claim 1 wherein the diameters of the apertures in each plate exceed the thickness of the plate in which the apertures are formed.

3. Apparatus as in claim 2 wherein the apertures of the first plurality each have a diameter of approximately 0.033 inches and said front plate is about 0.018 inches thick.

4. Apparatus as in claim 3 wherein the apertures of the second plurality each have a diameter of about 0.250 inches and said rear plate is about 0.049 inches thick.

5. Apparatus as in claim 4 including a central hole in each of said plates for receiving an ignitor.

6. Apparatus as in claim 5 wherein said two plates are secured together by a plurality of welds disposed in a matrix surrounding apertures of said second plurality of apertures.

7. Apparatus as in claim 4 wherein the apertures in said rear plate are on centers spaced about 0.313 inches apart.

8. Apparatus as in claim 7 wherein the apertures in said front plate are on centers spaced about 0.055 inches apart.

9. Apparatus as in claim 1 wherein the apertures in said rear plate comprise about 58% of said rear plate.

10. Apparatus as in claim 1 wherein the apertures in said front plate comprise about 35% of said front plate.

11. An ignitor for a premix gas burner and comprising:

a first elongated electrode having an ignition tip;

an insulating sleeve on said electrode;

a second electrode wrapped around said sleeve proximate said ignition tip and extending away from an end of said sleeve to a portion near said tip for providing a grounding electrode.

12. Apparatus as in claim 11 further including a pilot tube disposed about said sleeve for conveying pilot gas and air mixture from a rearward end of said sleeve forwardly to said ignitor tip, said second electrode being in electrical contact with said tube.

13. Apparatus as in claim 12 wherein both electrodes extend forwardly and outwardly of said pilot tube.

14. Apparatus as in claim 13 wherein said pilot tube is mounted within a burner housing comprising a gas and air mixing tube.

15. Apparatus as in claim 14 further including a burner plate supporting a forward end of said pilot tube in said burner housing.

16. Apparatus as in claim 15 wherein said pilot tube and burner plate extend into said housing from a rearward end thereof and are removable as a unit from a rearward end of said housing.

17. Apparatus as in claim 16 further including a gas and air inlet in said burner housing and another gas and air inlet disposed operably at a rearward end of said pilot tube.

18. A gas fired premix burner including:

a burner housing having a rear end and a forward burner end;

a pilot tube extending from said rear end toward said forward end;

a burner plate at said forward end;

said burner plate comprising a composite burner plate disposed on a forward end of said pilot tube within said housing;

a gas and air inlet disposed at a rear end of said housing;

a second gas and air inlet disposed at a rear end of said pilot tube; and a pilot flame ignitor extending from within said pilot tube forwardly through said burner plate beyond said housing.

19. Apparatus as in claim 18 further wherein said composite burner plate closes a forward end of said housing, said pilot flame ignitor extending forwardly of said burner plate.

20. Apparatus as in claim 19 wherein said housing is cylindrical and said burner plate is circular, said burner plate supporting said pilot tube axially in said housing and said burner plate and pilot tube being insertable as a unit into said burner housing from the rear of said housing.

21. Apparatus as in claim 20 wherein said housing has an inwardly tapered forward end, said burner plate being removably captured between said tapered end and a forward portion of said pilot tube.

22. Apparatus as in claim 19 wherein said burner plate has two flat components disposed face to face, an outer component having a plurality of openings of one diameter therethrough and an inner component having a plurality of larger openings therethrough.

23. Apparatus as in claim 22 wherein said components are welded together.

24. Apparatus as in claim 18 wherein said pilot flame ignitor comprises a center electrode, an insulating sleeve and a second electrode wrapped around said sleeve at its forward end.

25. Apparatus as in claim 24 wherein said second electrode resides in electric contact with said pilot tube.

26. Apparatus as in claim 18 wherein said housing has an inwardly tapered forward end, limiting forward motion of said burner plate, a rear housing plate, and said pilot tube extending and being captured between said burner plate and said rear housing plate.

27. A burner plate for a premix gas burner and comprising:

a flat front plate having a first plurality of apertures therein;

a flat rear plate having a second plurality of apertures therein, said second plurality of apertures having diameters larger than those of said first plurality of apertures;

apertures of said second plurality being disposed in operative alignment with, and overlying apertures of, said first plurality;

said plates being secured together to form a flat unitary burner plate.

* * * * *